US010657913B2

(12) United States Patent
Park et al.

(10) Patent No.: US 10,657,913 B2
(45) Date of Patent: May 19, 2020

(54) DISPLAY PANEL, DISPLAY APPARATUS HAVING THE SAME AND METHOD OF DRIVING THE SAME

(71) Applicant: SAMSUNG DISPLAY CO., LTD., Yongin-si, Gyeonggi-do (KR)

(72) Inventors: Jun Hyun Park, Suwon-si (KR); Kyoung-Ju Shin, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 109 days.

(21) Appl. No.: 15/152,173

(22) Filed: May 11, 2016

(65) Prior Publication Data

US 2017/0018237 A1 Jan. 19, 2017

(30) Foreign Application Priority Data

Jul. 16, 2015 (KR) ..... 10-2015-0101091

(51) Int. Cl.
*G09G 3/36* (2006.01)

(52) U.S. Cl.
CPC ..... *G09G 3/3611* (2013.01); *G09G 3/3688* (2013.01); *G09G 3/3696* (2013.01)

(58) Field of Classification Search
CPC .. G09G 3/3611; G09G 3/3688; G09G 3/3696; H01L 29/78648
USPC ..... 345/90
See application file for complete search history.

(56) References Cited

U.S. PATENT DOCUMENTS 6,528,852 B2 * 3/2003 Takemura ..... H01L 29/41733 257/349
7,061,461 B2 6/2006 Hong
7,532,187 B2 * 5/2009 Afentakis ..... G09G 3/20 345/82
2008/0158125 A1 * 7/2008 Mori ..... G09G 3/3648 345/92
2011/0156025 A1 * 6/2011 Shionoiri ..... H01L 27/115 257/43
2012/0280213 A1 * 11/2012 Gau ..... H01L 51/0048 257/29
2013/0141320 A1 6/2013 Kim
2014/0015821 A1 * 1/2014 Hwang ..... G09G 3/20 345/211
2015/0084946 A1 * 3/2015 Shim ..... G09G 3/3258 345/212

(Continued)

*Primary Examiner* — Yuzhen Shen
(74) *Attorney, Agent, or Firm* — F. Chau & Associates, LLC

(57) ABSTRACT

A display panel includes a gate line, first and second data lines, first and second gate control lines, and first and second pixels. The first pixel includes a double-gate switching element including a gate electrode connected to the gate line, a source electrode connected to the first data line, and another gate electrode connected to the first gate control line. The second pixel includes a double-gate switching element including a gate electrode connected to the gate line, a source electrode connected to the second data line, and a gate electrode connected to the second gate control line. A data voltage having a first polarity is applied to the first data line, another data voltage having a second polarity is applied to the second data line, and first and second gate control voltages are respectively applied to the first and second gate control lines.

19 Claims, 9 Drawing Sheets

(56) References Cited

U.S. PATENT DOCUMENTS

2016/0099258 A1* 4/2016 Yoneda ..... H01L 27/124
257/43

* cited by examiner

DISPLAY PANEL, DISPLAY APPARATUS HAVING THE SAME AND METHOD OF DRIVING THE SAME

CROSS-REFERENCE TO RELATED APPLICATION

This application claims priority under 35 U.S.C. § 119 to Korean Patent Application No. 10-2015-0101091, filed on Jul. 16, 2015, the disclosure of which is herein incorporated by reference in its entirety.

TECHNICAL FIELD

Exemplary embodiments of the present inventive concept relate generally to a display device, and more particularly to a display panel, a display apparatus including the display panel, and a method of driving the display panel.

DISCUSSION OF THE RELATED ART

A liquid crystal display (LCD) apparatus typically includes a display panel and a panel driver configured to drive the display panel. The display panel includes a plurality of gate lines, a plurality of data lines and a plurality of pixels. Each of the pixels has a switching element configured to drive a liquid crystal cell. The switching element includes a gate electrode, a drain electrode and a source electrode.

A parasitic capacitor disposed between the gate electrode and the drain electrode contributes to a voltage shift of the liquid crystal cell. The voltage shift is a kickback voltage.

The liquid crystal cell is charged with a voltage that is less than a data voltage due to being reduced by the kickback voltage. For example, the liquid crystal cell is charged with a voltage having a potential difference reduced by the kickback voltage, and that is thus, less than the data voltage in relation to a common voltage, when operated based on a positive polarity. Further, the liquid crystal cell is charged with a voltage having a potential difference increased by the kickback voltage, and that is thus, greater than the data voltage in relation to the common voltage, when operated based on a negative polarity. As a result, flicker may appear on a screen of the LCD apparatus, and the charging rate of the pixels may decrease.

SUMMARY

Exemplary embodiments of the present inventive concept provide a display panel capable of improving display quality.

Exemplary embodiments of the present inventive concept provide a display apparatus including the display panel.

Exemplary embodiments of the present inventive concept provide a method of driving the display panel.

A display panel according to an exemplary embodiment of the present inventive concept includes a first gate line, first and second data lines, first and second gate control lines, a first pixel and a second pixel. The first gate line extends in a first direction. The first and second data lines extend in a second direction crossing the first direction. The first pixel includes a first double-gate switching element including a first gate electrode connected to the first gate line, a first source electrode connected to the first data line, and a second gate electrode connected to the first gate control line. The second pixel includes a second double-gate switching element including a third gate electrode connected to the first gate line, a second source electrode connected to the second data line, and a fourth gate electrode connected to the second gate control line. A first data voltage having a first polarity is applied to the first data line. A second data voltage having a second polarity different from the first polarity is applied to the second data line. A first gate control voltage is applied to the first gate control line. A second gate control voltage different from the first gate control voltage is applied to the second gate control line.

In an exemplary embodiment, the first polarity may be a positive polarity and the second polarity may be a negative polarity.

In an exemplary embodiment, a difference between a first voltage and a second voltage may be substantially the same as a difference between the first data voltage and the second data voltage. The first voltage is a difference between the first gate control voltage and the first data voltage, and the second voltage is a difference between the second gate control voltage and the second data voltage.

In an exemplary embodiment, the second gate control voltage may be substantially the same as the second data voltage.

In an exemplary embodiment, the first and second gate control lines extend in the second direction.

In an exemplary embodiment, the display panel may further include a second gate line extending in the first direction, a third data line and a third gate control line extending in the second direction, a third pixel adjacent to the first pixel along the second direction, and including a third double-gate switching element including a fifth gate electrode connected to the second gate line, a third source electrode connected to the second data line, and a sixth gate electrode connected to the second gate control line, and a fourth pixel adjacent to the second pixel along the second direction, and including a fourth double-gate switching element including a seventh gate electrode connected to the second gate line, a fourth source electrode connected to the third data line, and an eighth gate electrode connected to the third gate control line. A third data voltage having the first polarity may be applied to the third data line. The first gate control voltage may be applied to the third gate control line.

A display apparatus according to an exemplary embodiment of the present inventive concept includes a display panel, a gate driver and a data driver. The display panel includes a first gate line extending in a first direction, first and second data lines extending in a second direction crossing the first direction, first and second gate control lines, a first pixel including a first double-gate switching element including a first gate electrode connected to the first gate line, a first source electrode connected to the first data line, and a second gate electrode connected to the first gate control line, and a second pixel including a second double-gate switching element including a third gate electrode connected to the first gate line, a second source electrode connected to the second data line, and a fourth gate electrode connected to the second gate control line. The gate driver may be configured to apply a first gate signal to the first gate line. The data driver may be configured to apply a first data voltage having a first polarity to the first data line, and may be configured to apply a second data voltage having a second polarity different from the first polarity to the second data line. A gate control voltage generator may be configured to apply a first gate control voltage to the first gate control line, and may be configured to apply a second gate control voltage different from the first gate control voltage to the second gate control line.

In an exemplary embodiment, the first polarity may be a positive polarity and the second polarity may be a negative polarity.

In an exemplary embodiment, a difference between a first voltage and a second voltage may be substantially the same as a difference between the first data voltage and the second data voltage. The first voltage is a difference between the first gate control voltage and the first data voltage, and the second voltage is a difference between the second gate control voltage and the second data voltage.

In an exemplary embodiment, the first and second gate control lines may extend in the second direction.

In an exemplary embodiment, the first gate control line overlaps with the first data line, and the second gate control line overlaps with the second data line.

In an exemplary embodiment, the display panel may further include a second gate line extending in the first direction, a third data line and a third gate control line extending in the second direction, a third pixel adjacent to the first pixel along the second direction, and including a third double-gate switching element including a fifth gate electrode connected to the second gate line, a third source electrode connected to the second data line, and a sixth gate electrode connected to the second gate control line, and a fourth pixel adjacent to the second pixel along the second direction, and including a fourth double-gate switching element including a seventh gate electrode connected to the second gate line, a fourth source electrode connected to the third data line, and an eighth gate electrode connected to the third gate control line. The gate driver may be configured to apply a second gate signal to the second gate line. The gate control voltage generator may be configured to apply the first gate control voltage to the third gate control line.

In an exemplary embodiment, the data driver may be configured to apply a third data voltage having the first polarity to the third data line.

In an exemplary embodiment, the display apparatus may further include a switching part including switches, and configured to divide the first data voltage using a time division scheme based on operations of the switches, and to apply the time-divided first data voltage to the first and third data lines.

A method of driving the display panel includes applying a first gate signal to a first gate electrode of a first double-gate switching element of a first pixel of the display panel, applying the first gate signal to a third gate electrode of a second double-gate switching element of a second pixel of the display panel, applying a first data voltage having a first polarity to a first source electrode of the first double-gate switching element, applying a second data voltage having a second polarity different from the first polarity to a second source electrode of the second double-gate switching element, and generating a first gate control voltage and a second gate control voltage based on the first and second data voltages. The second gate control voltage is different from the first gate control voltage. The method further includes applying the first gate control voltage to a second gate electrode of the first double-gate switching element, and applying the second gate control voltage to a fourth gate electrode of the second double-gate switching element.

In an exemplary embodiment, the first polarity may be a positive polarity and the second polarity may be a negative polarity.

In an exemplary embodiment, a difference between a first voltage and a second voltage may be substantially the same as a difference between the first data voltage and the second data voltage. The first voltage is a difference between the first gate control voltage and the first data voltage, and the second voltage is a difference between the second gate control voltage and the second data voltage.

In an exemplary embodiment, the second gate control voltage may be substantially the same as the second data voltage.

In an exemplary embodiment, the display panel may further include a third pixel including a third double-gate switching element including fifth and sixth gate electrodes and a third source electrode. The method may further include dividing the first data voltage using a time division scheme, applying the time-divided first data voltage to the first and third source electrodes, and applying the first gate control voltage to the sixth gate electrode.

A display panel driver according to an exemplary embodiment of the present inventive concept includes a gate driver that applies a first gate signal to a first gate line of a display panel, a data driver that applies a first data voltage having a first polarity to a first data line of the display panel, and a second data voltage having a second polarity different from the first polarity to a second data line of the display panel, and a gate control voltage generator that applies a first gate control voltage to a first gate control line of the display panel, and a second gate control voltage different from the first gate control voltage to a second gate control line of the display panel. The first gate line is connected to a first gate electrode of a first double-gate switching element of a first pixel of the display panel, the first data line is connected to a first source electrode of the first double-gate switching element, and the first gate control line is connected to a second gate electrode of the first double-switching element. The first gate line is further connected to a third gate electrode of a second double-gate switching element of a second pixel of the display panel, the second data line is connected to a second source electrode of the second double-gate switching element, and the second gate control line is connected to a fourth gate electrode of the second double-gate switching element.

According to exemplary embodiments, a top-gate voltage of a double-gate switching element is adjusted based on a data voltage having a positive polarity and a data voltage having a negative polarity to reduce a kickback voltage. Thus, the display quality of the display panel can be improved.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EXEMPLARY EMBODIMENTS

Exemplary embodiments of the present inventive concept will be described more fully hereinafter with reference to the accompanying drawings.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. In addition, it will also be understood that when a layer is referred to as being "between" two layers, it can be the only layer between the two layers, or one or more intervening layers may also be present.

It will be understood that when a component is referred to as being "on", "connected to", "coupled to", or "adjacent to" another component, it can be directly on, connected to, coupled to, or adjacent to the other component, or intervening components may also be present. It will also be understood that when a component is referred to as being "between" two components, it can be the only component between the two components, or one or more intervening components may also be present.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

Herein, when two or more elements or values (e.g., voltages) are described as being substantially the same as or about equal to each other, it is to be understood that the elements or values are identical to each other, indistinguishable from each other, or distinguishable from each other but functionally the same as each other as would be understood by a person having ordinary skill in the art.

Figure 1:
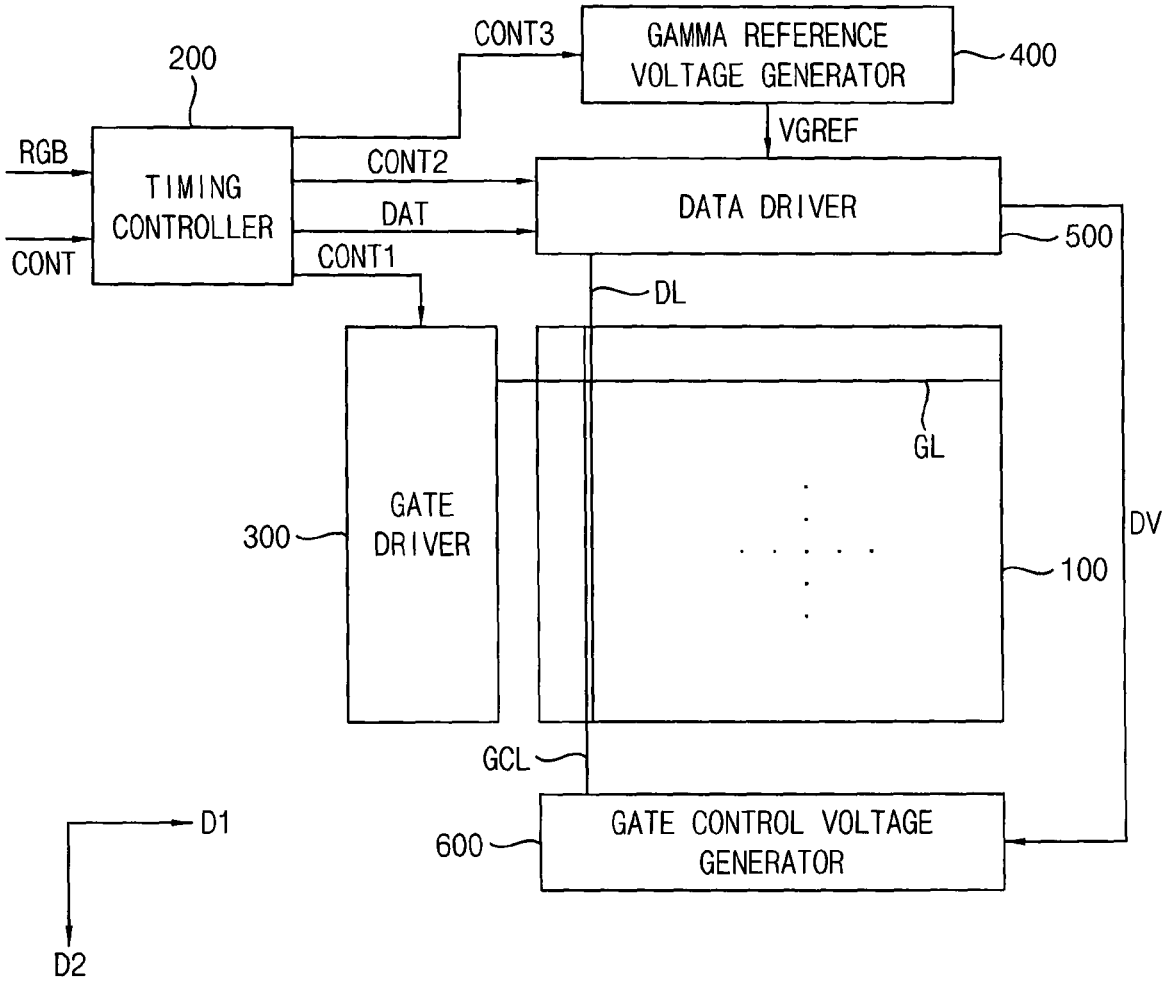
FIG. 1 is a block diagram illustrating a display apparatus according to exemplary embodiments of the present inventive concept.

FIG. 1 is a block diagram illustrating a display apparatus according to exemplary embodiments of the present inventive concept.

Referring to FIG. 1, the display apparatus includes a display panel 100 and a panel driver. The panel driver includes a timing controller 200 (e.g., a timing controller circuit 200), a gate driver 300 (e.g., a gate driver circuit 300), a gamma reference voltage generator 400 (e.g., a gamma reference voltage generator circuit 400), a data driver 500 (e.g., a data driver circuit 500) and a gate control voltage generator 600 (e.g., a gate control voltage generator circuit 600).

The display panel 100 includes a display region in which an image is displayed and a peripheral region adjacent to the display region.

The display panel 100 includes a plurality of gate lines GL, a plurality of data lines DL, a plurality of gate control lines GCL and a plurality of pixels connected to the gate lines GL and the data lines DL. The gate lines GL extend in a first direction D1 and the data lines DL extend in a second direction D2 crossing the first direction D1. The gate control lines GCL may extend in the second direction D2.

In exemplary embodiments, the pixels may include a double-gate switching element, a liquid crystal capacitor and a storage capacitor. The liquid crystal capacitor and the storage capacitor may be electrically connected to the double-gate switching element. The pixels may be arranged in a matrix configuration.

The display panel 100 and the double-gate switching element will be described in detail with reference to FIGS. 2A, 2B, 3A and 3B.

The timing controller 200 receives input image data RGB and an input control signal CONT from an external device (e.g., a device external to the display apparatus). The input image data RGB may include, for example, red image data R, green image data G and blue image data B. In exemplary embodiments, input image data including other colors such as, for example, cyan, yellow and magenta may be input to the timing controller 200. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DAT based on the input image data RGB and the input control signal CONT.

The first control signal CONT1 generated by the timing controller 200 controls operations of the gate driver 300. The timing controller 200 generates the first control signal CONT1 based on the input control signal CONT, and outputs the first control signal CONT1 to the gate driver 300. The first control signal CONT1 may include, for example, a vertical start signal and a gate clock signal.

The second control signal CONT2 generated by the timing controller 200 controls operations of the data driver 500. The timing controller 200 generates the second control signal CONT2 based on the input control signal CONT, and outputs the second control signal CONT2 to the data driver 500. The second control signal CONT2 may include, for example, a horizontal start signal and a load signal.

The timing controller 200 generates the data signal DAT based on the input image data RGB. The timing controller 200 outputs the data signal DAT to the data driver 500.

The third control signal CONT3 generated by the timing controller 200 controls operations of the gamma reference voltage generator 400. The timing controller 200 generates the third control signal CONT3 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

In exemplary embodiments, the gate driver 300 may be directly mounted on the display panel 100, or may be connected to the display panel 100 as, for example, a tape carrier package (TCP) type. Alternatively, the gate driver 300 may be integrated on the peripheral region of the display panel 100. However, the mounting scheme and location of the gate driver 300 is not limited thereto.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In exemplary embodiments, the gamma reference voltage generator 400 may be disposed in the timing controller 200 or may be disposed in the data driver 500. However, the location of the gamma reference voltage generator 400 is not limited thereto.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 outputs the data voltages to the data lines DL.

The data driver 500 generates a data voltage signal DV based on the data voltages. The data driver 500 outputs the data voltage signal DV to the gate control voltage generator 600. The data voltage signal DV includes information about the data voltages.

In exemplary embodiments, the data driver 500 may be directly mounted on the display panel 100 or may be connected to the display panel 100 as a tape carrier package (TCP) type. Alternatively, the data driver 500 may be integrated on the peripheral region of the display panel 100. However, the mounting scheme and location of the data driver 500 is not limited thereto.

The gate control voltage generator 600 generates gate control voltages based on the data voltage signal DV received from the data driver 500. The gate control voltage generator 600 outputs the gate control voltages to the gate control lines GCL.

The gate control voltages will be described in detail with reference to FIGS. 4C and 4D.

Figure 2A:
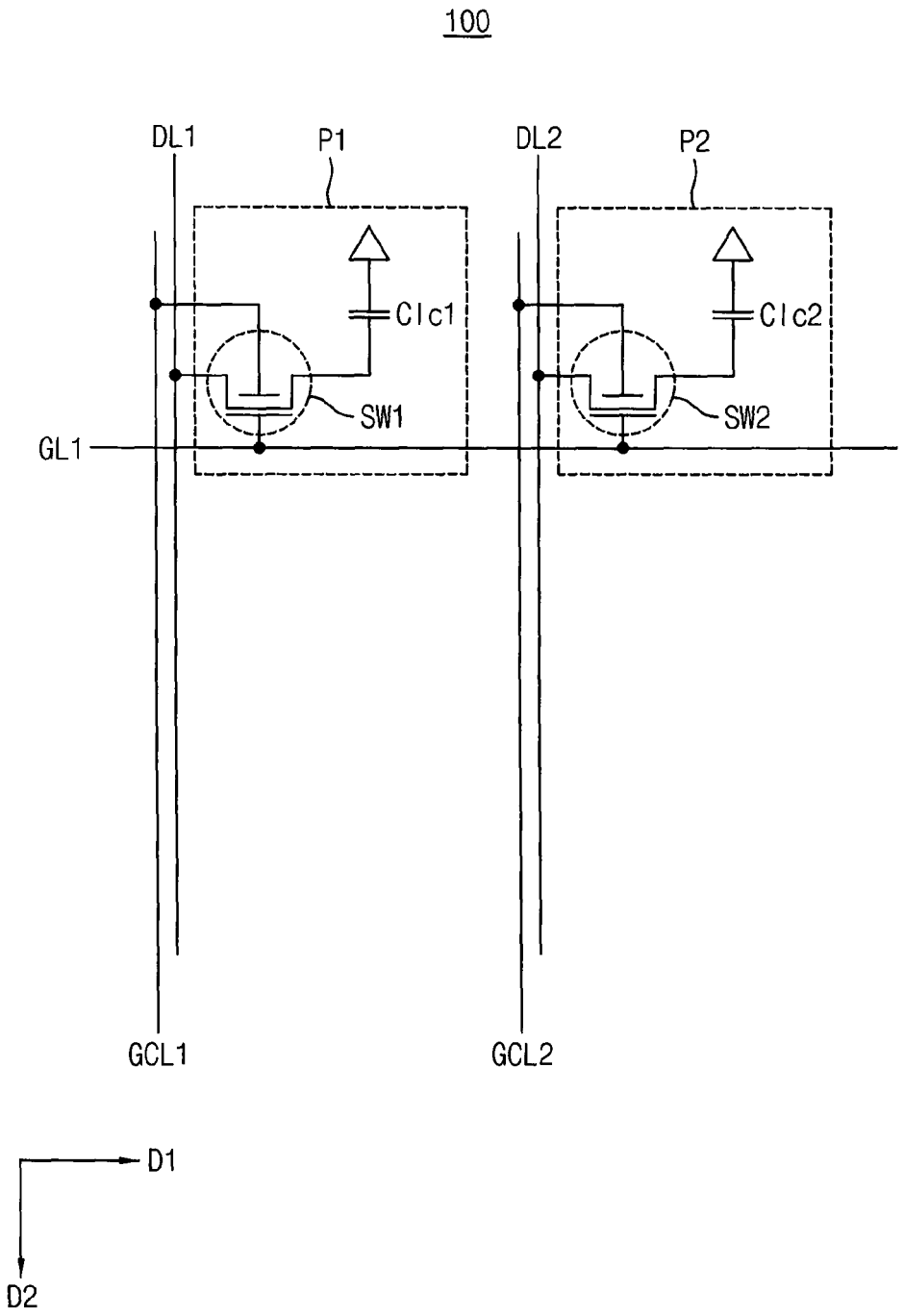
FIG. 2A is a block diagram illustrating a display panel included in a display apparatus according to exemplary embodiments of the present inventive concept.

FIG. 2A is a block diagram illustrating a display panel included in a display apparatus according to exemplary embodiments of the present inventive concept.

Referring to FIGS. 1 and 2A, the display panel 100 includes a first gate line GL1 extending in the first direction D1. The gate driver 300 may output a first gate signal to the first gate line GL1.

The display panel 100 further includes first and second data lines DL1 and DL2 extending in the second direction D2. The data driver 500 outputs a first data voltage having a first polarity to the first data line DL1. The data driver 500 outputs a second data voltage having a second polarity different from the first polarity to the second data line DL2. For example, the first polarity may be a positive polarity and the second polarity may be a negative polarity. Alternatively, the first polarity may be a negative polarity and the second polarity may be a positive polarity. The second data line DL2 may be adjacent to the first data line DL1 along the first direction D1.

The display panel 100 includes first and second gate control lines GCL1 and GCL2. The gate control voltage generator 600 outputs a first gate control voltage to the first gate control line GCL1. The gate control voltage generator 600 outputs a second gate control voltage different from the first gate control voltage to the second gate control line GCL2. A difference between the first gate control voltage and the second gate control voltage may be substantially the same as a difference between the first data voltage and the second data voltage. The second gate control voltage may be substantially the same as the second data voltage. The first and second gate control lines GCL1 and GCL2 may extend in the second direction D2. The second gate control line GCL2 may be adjacent to the first gate control line GCL1. The first gate control line GCL1 may overlap with the first data line DL1. The second gate control line GCL2 may overlap with the second data line DL2.

The first and second gate control lines GCL1 and GCL2 and the first and second data lines DL1 and DL2 will be described in detail with reference to FIG. 3B. The first and second gate control voltages and the first and second data voltages will be described in detail with reference to FIGS. 4C and 4D.

The display panel 100 includes first and second pixels P1 and P2. The first pixel P1 includes a first double-gate switching element SW1. The first pixel P1 may further include a first liquid crystal capacitor Clc1 and a first storage capacitor. The first double-gate switching element SW1 includes first and second gate electrodes, a first source electrode and a first drain electrode. The first gate electrode may be a bottom gate electrode. The second gate electrode may be a top gate electrode. The first gate electrode is connected to the first gate line GL1. The first source electrode is connected to the first data line DL1. The second gate electrode is connected to the first gate control line GCL1. The first drain electrode may be connected to the first liquid crystal capacitor Clc1.

The first double-gate switching element SW1 will be described in detail with reference to FIGS. 3A and 3B.

The second pixel P2 includes a second double-gate switching element SW2. The second pixel P2 may further include a second liquid crystal capacitor Clc2 and a second storage capacitor. The second double-gate switching element SW2 includes third and fourth gate electrodes, a second source electrode and a second drain electrode. The third gate electrode may be a bottom gate electrode. The fourth gate electrode may be a top gate electrode. The third gate electrode is connected to the first gate line GL1. The second source electrode is connected to the second data line DL2. The fourth gate electrode is connected to the second gate control line GCL2. The second drain electrode may be connected to the second liquid crystal capacitor Clc2.

Figure 2B:
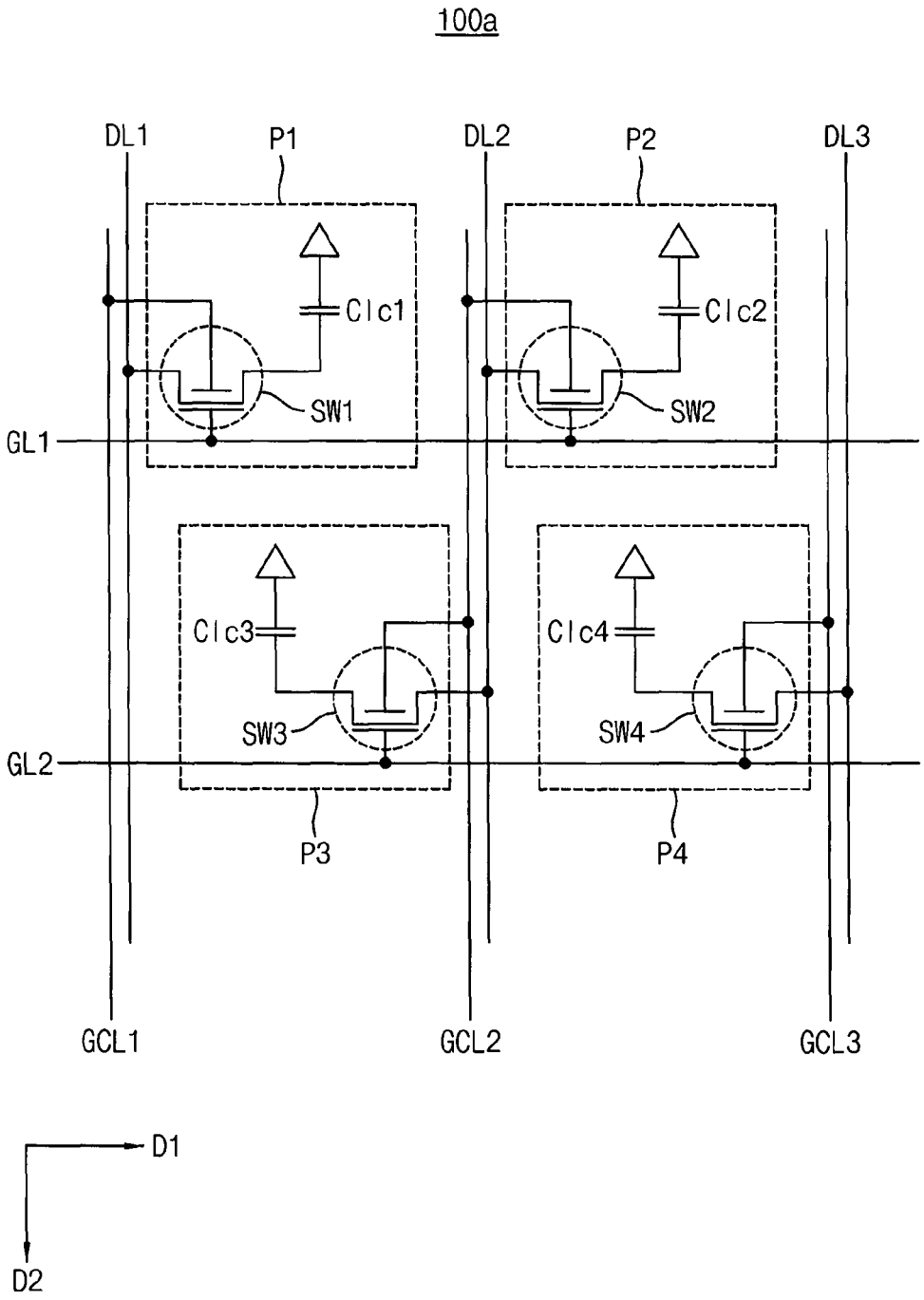
FIG. 2B is a block diagram illustrating a display panel included in a display apparatus according to exemplary embodiments of the present inventive concept.

FIG. 2B is a block diagram illustrating a display panel included in a display apparatus according to exemplary embodiments of the present inventive concept.

Referring to FIGS. 1 and 2B, the display panel 100*a* of FIG. 2B corresponds to the display panel 100 of FIG. 1 according to an exemplary embodiment. The display panel 100*a* includes a first gate line GL1 extending in the first direction D1. The display panel 100*a* may further include a second gate line GL2 extending in the first direction D1. The gate driver 300 may output a first gate signal to the first gate line GL1. The gate driver 300 may output a second gate signal to the second gate line GL2. The second gate line GL2 may be adjacent to the first gate line GL1 along the second direction D2.

The display panel 100*a* includes first and second data lines DL1 and DL2 extending in the second direction D2. The display panel 100*a* may further include a third data line DL3 extending in the second direction D2. The data driver 500 outputs a first data voltage having a first polarity to the first data line DLL The data driver 500 outputs a second data voltage having a second polarity different from the first polarity to the second data line DL2. The data driver 500 may output a third data voltage having the first polarity to the third data line DL3. For example, the first polarity may be a positive polarity and the second polarity may be a negative polarity. Alternatively, the first polarity may be a negative polarity and the second polarity may be a positive polarity. The second data line DL2 may be adjacent to the first data line DL1 along the first direction D1. The third data line DL3 may be adjacent to the second data line DL2 along the first direction D1.

The display panel 100*a* includes first and second gate control lines GCL1 and GCL2. The display panel 100*a* may further include a third gate control line GCL3. The gate control voltage generator 600 outputs a first gate control voltage to the first gate control line GCL1. The gate control voltage generator 600 outputs a second gate control voltage different from the first gate control voltage to the second gate control line GCL2. The gate control voltage generator 600 may output the first gate control voltage to the third gate control line GCL3. A difference between the first gate control voltage and the second gate control voltage may be substantially the same as a difference between the first data voltage and the second data voltage. The second gate control voltage may be substantially the same as the second data voltage. The first, second and third gate control lines GCL1, GCL2 and GCL3 may extend in the second direction D2. The second gate control line GCL2 may be adjacent to the first gate control line GCL1. The third gate control line GCL3 may be adjacent to the second gate control line GCL2. The first gate control line GCL1 may overlap with the first data line DL1. For example, a portion of the first gate control line GCL1 may extend in the first direction D1 and overlap with the first data line DL1 extending in the second direction D2, or a portion of the first data line DL1 may extend in the first direction D1 and overlap with the first gate control line GCL1 extending in the second direction. The second gate control line GCL2 may overlap with the second data line DL2. For example, a portion of the second gate control line GCL2 may extend in the first direction D1 and overlap with the second data line DL2 extending in the second direction D2, or a portion of the second data line DL2 may extend in the first direction D1 and overlap with the second gate control line GCL2 extending in the second direction. The third gate control line GCL3 may overlap with the third data line DL3. For example, a portion of the third gate control line GCL3 may extend in the first direction D1 and overlap with the third data line DL3 extending in the second direction D2, or a portion of the third data line DL3 may extend in the first direction D1 and overlap with the third gate control line GCL3 extending in the second direction D2.

The display panel 100*a* includes first and second pixels P1 and P2. The display panel 100*a* may further include third and fourth pixels P3 and P4. The first pixel P1 includes a first double-gate switching element SW1. The first pixel P1 may further include a first liquid crystal capacitor Clc1 and a first storage capacitor. The first double-gate switching element SW1 includes first and second gate electrodes, a first source electrode and a first drain electrode. The first gate electrode may be a bottom gate electrode. The second gate electrode may be a top gate electrode. The first gate electrode is connected to the first gate line GL1. The first source electrode is connected to the first data line DLL The second gate electrode is connected to the first gate control line GCL1. The first drain electrode may be connected to the first liquid crystal capacitor Clc1.

The second pixel P2 includes a second double-gate switching element SW2. The second pixel P2 may further include a second liquid crystal capacitor Clc2 and a second storage capacitor. The second double-gate switching element SW2 includes third and fourth gate electrodes, a second source electrode and a second drain electrode. The third gate electrode may be a bottom gate electrode. The fourth gate electrode may be a top gate electrode. The third gate electrode is connected to the first gate line GL1. The second source electrode is connected to the second data line DL2. The fourth gate electrode is connected to the second gate control line GCL2. The second drain electrode may be connected to the second liquid crystal capacitor Clc2.

The third pixel P3 may be adjacent to the first pixel P1 along the second direction D2. The third pixel P3 includes a third double-gate switching element SW3. The third pixel P3 may further include a third liquid crystal capacitor Clc3 and a third storage capacitor. The third double-gate switching element SW3 includes fifth and sixth gate electrodes, a third source electrode and a third drain electrode. The fifth gate electrode may be a bottom gate electrode. The sixth gate electrode may be a top gate electrode. The fifth gate electrode is connected to the second gate line GL2. The third source electrode is connected to the second data line DL2. The sixth gate electrode is connected to the second gate control line GCL2. The third drain electrode may be connected to the third liquid crystal capacitor Clc3.

The fourth pixel P4 may be adjacent to the second pixel P2 along the second direction D2. The fourth pixel P4 may be adjacent to the third pixel P3 along the first direction D1. The fourth pixel P4 includes a fourth double-gate switching element SW4. The fourth pixel P4 may include a fourth liquid crystal capacitor Clc4 and a fourth storage capacitor. The fourth double-gate switching element SW4 includes seventh and eighth gate electrodes, a fourth source electrode and a fourth drain electrode. The seventh gate electrode may be a bottom gate electrode. The eighth gate electrode may be a top gate electrode. The seventh gate electrode is connected to the second gate line GL2. The fourth source electrode is connected to the third data line DL3. The eighth gate electrode is connected to the third gate control line GCL3. The fourth drain electrode may be connected to the fourth liquid crystal capacitor Clc4.

The first double-gate switching element SW1 will be described herein according to exemplary embodiments of the present inventive concept. It is to be understood that the second double-gate switching element SW2, the third double-gate switching element SW3 and the fourth double-gate switching element SW4 may have a similar structure as that of the first double-gate switching element SW1 as described herein.

Figure 3A:
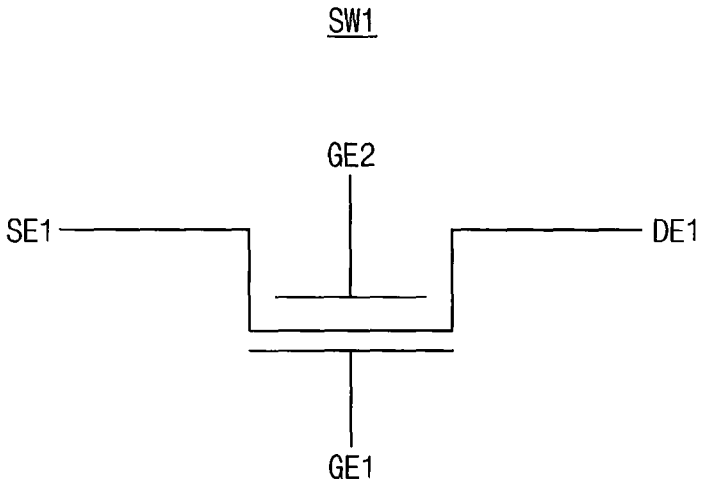
FIG. 3A is a circuit diagram illustrating a double-gate switching element included in a display apparatus according to exemplary embodiments of the present inventive concept.

FIG. 3A is a circuit diagram illustrating a double-gate switching element included in a display apparatus according to exemplary embodiments of the present inventive concept.

Referring to FIGS. 2A and 3A, the first double-gate switching element SW1 includes a first gate electrode GE1, a first source electrode SE1, a second gate electrode GE2 and a first drain electrode DE1.

The first gate electrode GE1 is connected to the first gate line GL1. The first gate electrode GE1 may be a bottom gate electrode of a double-gate switching element. The first gate signal may be output to the first gate electrode GE1 through the first gate line GL1.

The first source electrode SE1 is connected to the first data line DL1. The first data voltage is output to the first source electrode SE1 through the first date line DL1.

The second gate electrode GE2 is connected to the first gate control line GCL1. The second gate electrode GE2 may be a top gate electrode of the double-gate switching element. The first gate control voltage is output to the second gate electrode GE2 through the first gate control line GCL1.

The first drain electrode DE1 may be connected to the first liquid crystal capacitor Clc1.

Figure 3B:
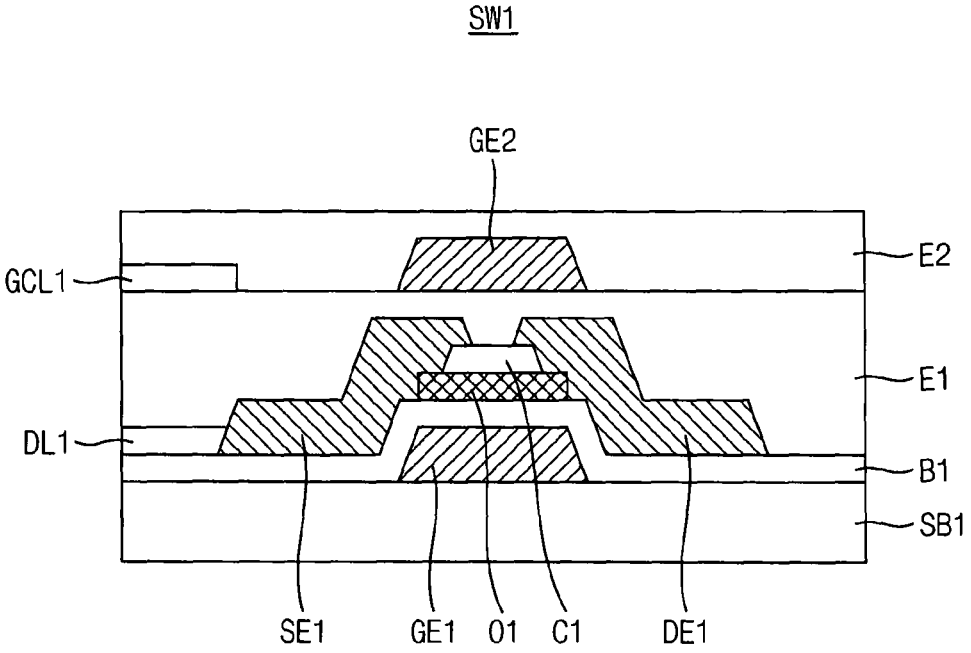
FIG. 3B is a cross-sectional diagram illustrating a double-gate switching element included in a display apparatus according to exemplary embodiments of the present inventive concept.

FIG. 3B is a cross-sectional diagram illustrating a double-gate switching element included in a display apparatus according to exemplary embodiments of the present inventive concept.

Referring to FIGS. 2A and 3B, the first double-gate switching element SW1 may include a first substrate SB1, a first gate electrode GE1, a first gate insulating layer B1, a first source electrode SE1, a first drain electrode DE1, a first semiconductor layer O1, a first etch stopper C1, a first insulating layer E1, a second gate electrode GE2 and a second insulating layer E2. The first gate electrode GE1 is disposed on the first substrate SB1 and is connected to the first gate line GL1. The first gate insulating layer B1 is disposed on the first gate electrode GE1. The first source electrode SE1 is disposed on the first gate insulating layer B1 and is connected to the first data line DL1. The first drain electrode DE1 is spaced apart from the first source electrode SE1. The first semiconductor layer O1 forms a channel between the first source electrode SE1 and the first drain electrode DE1. The first etch stopper C1 is disposed on the first semiconductor layer O1 and protects the first semiconductor layer O1. The first insulating layer E1 covers the first substrate SB1. The second gate electrode GE2 is disposed on the first insulating layer E1 and is connected to the first gate control line GCL1. The second insulating layer E2 covers the first insulating layer E1.

The first data line DL1 may be disposed on the first gate insulating layer B1 and may be connected to the first source electrode SE1. The first gate control line GCL1 may be disposed on the first insulating layer E1 and may be connected to the second gate electrode GE2. The first gate control line GCL1 may be disposed on the first data line DL1. For example, the first gate control line GCL1 may be disposed on the first data line DL1 with intervening elements disposed therebetween. The intervening elements may be, for example, the first insulating layer E1.

In the first double-gate switching element SW1, a threshold voltage is shifted depending on the first gate control voltage output to the second gate electrode GE2.

An operation of the first double-gate switching element SW1 will be described in detail with reference to FIGS. 4C and 4D.

Figure 4A:
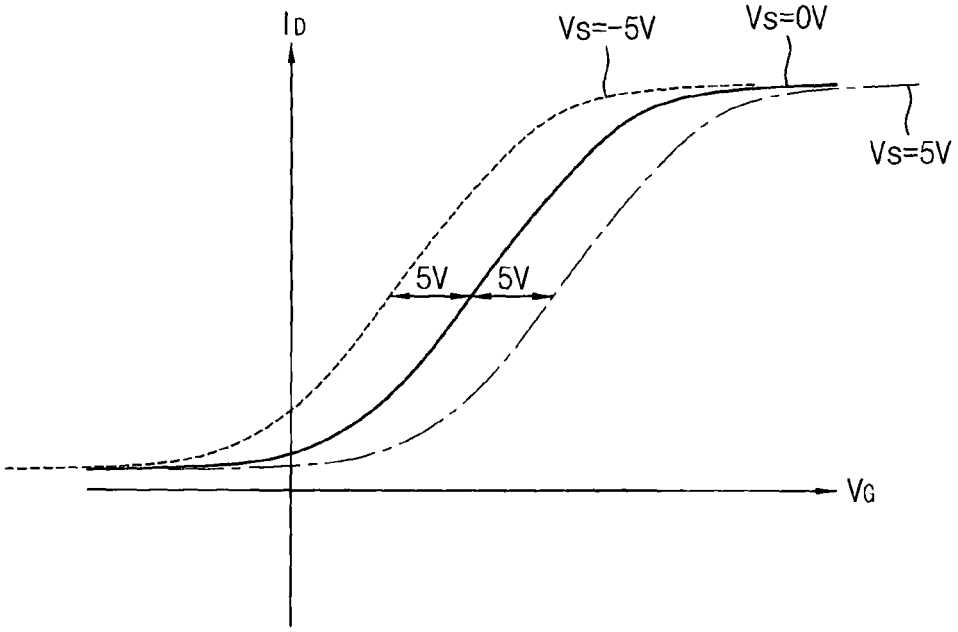
FIG. 4A is a diagram illustrating a relationship between a gate voltage of a switching element and a drain current of the switching element depending on a source voltage of the switching element according to a comparative example.

FIG. 4A is a diagram illustrating a relationship between a gate voltage VG of a switching element and a drain current ID of the switching element depending on a source voltage of the switching element according to a comparative example.

Referring to FIG. 4A, a switching element includes a gate electrode, a source electrode and a drain electrode. A gate voltage VG is applied to the gate electrode. A source voltage VS is applied to the source electrode. As a difference between the gate voltage VG and the source voltage VS becomes greater than a threshold voltage of the switching element, a drain current flows between the drain electrode and the source electrode. Thus, the gate voltage VG to turn on the switching element depends on the source voltage VS.

For example, in an exemplary scenario, the gate voltage VG to turn on the switching element when the source voltage VS is 5V is greater by 5V than the gate voltage VG to turn on the switching element when the source voltage VS is 0V. The gate voltage VG to turn on the switching element when the source voltage VS is −5V is smaller by 5V than the gate voltage VG to turn on the switching element when the source voltage VS is 0V.

Figure 4B:
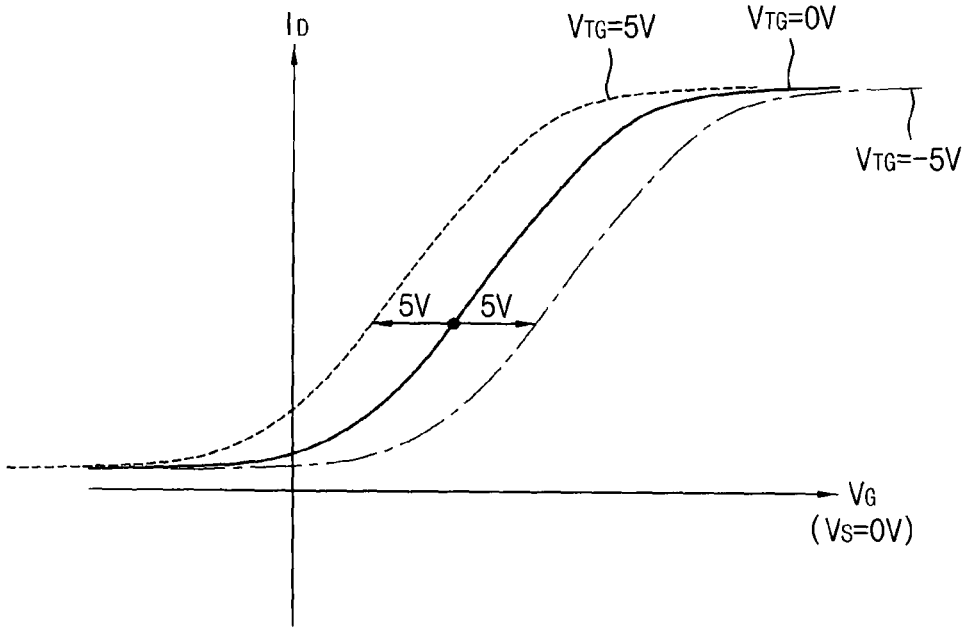
FIG. 4B is a diagram illustrating a relationship between a gate voltage of a double-gate switching element and a drain current of the double-gate switching element depending on a gate control voltage of the double-gate switching element according to a comparative example.

FIG. 4B is a diagram illustrating a relationship between a gate voltage VG of a double-gate switching element and a drain current ID of the double-gate switching element depending on a gate control voltage of the double-gate switching element according to a comparative example.

Referring to FIG. 4B, a double-gate switching element includes a bottom gate electrode, a source electrode, a top gate electrode and a drain electrode. A bottom gate voltage VG is applied to the bottom gate electrode. A source voltage VS is applied to the source electrode. A top gate voltage VTG is applied to the top gate electrode. As a difference between the bottom gate voltage VG and the source voltage VS becomes greater than a threshold voltage of the double-gate switching element, a drain current flows between the drain electrode and the source electrode. The threshold voltage of the double-gate switching element is shifted depending on a difference between the top gate voltage VTG and the source voltage VS.

For example, in an exemplary scenario, when the source voltage VS is 0V, the threshold voltage when the top gate voltage VTG is 5V is smaller than the threshold voltage when the top gate voltage VTG is 0V, and the threshold voltage when the top gate voltage VTG is −5V is greater than the threshold voltage when the top gate voltage VTG is 0V.

Figure 4C:
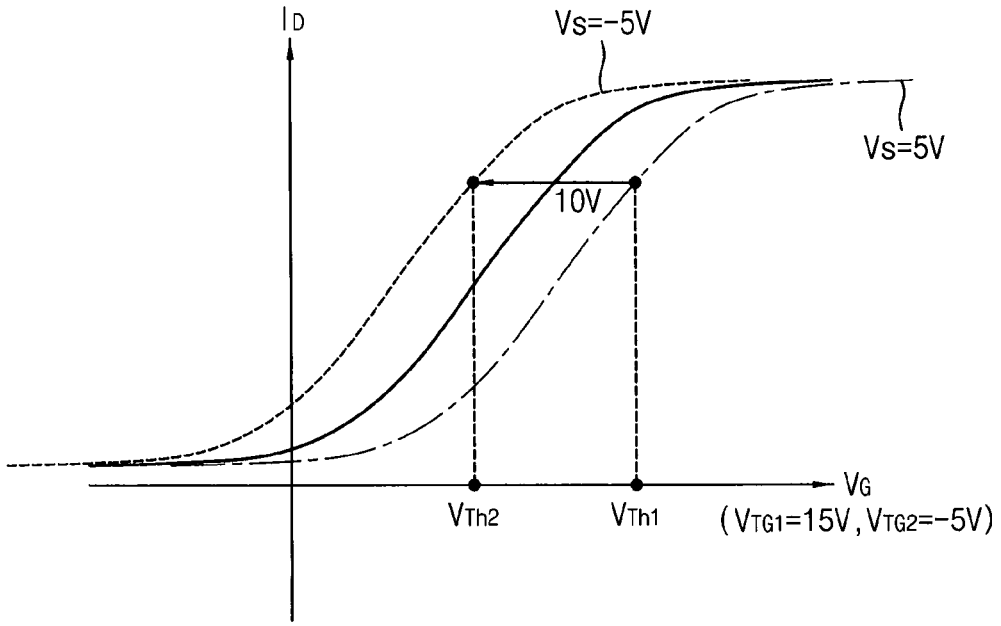
FIG. 4C is a diagram illustrating a relationship between a gate voltage of a double-gate switching element and a drain current of the double-gate switching element according to exemplary embodiments of the present inventive concept.

FIG. 4C is a diagram illustrating a relationship between a gate voltage VG of a double-gate switching element and a drain current ID of the double-gate switching element according to exemplary embodiments of the present inventive concept.

Referring to FIGS. 2A, 3A and 4C, a first threshold voltage VTh1 is a threshold voltage of the first double-gate switching element SW1 when a first data voltage VS applied to the first source electrode SE1 of the first double-gate switching element SW1 is 5V. A second threshold voltage VTh2 is a threshold voltage of the second double-gate switching element SW2 when a second data voltage VS applied to the second source electrode SE2 of the second double-gate switching element SW2 is −5V. The first threshold voltage VTh1 is greater than the second threshold voltage VTh2 by 10V.

In this case, in an exemplary scenario, a first gate control voltage VTG1 of 15V is applied to the second gate electrode GE2 of the first double-gate switching element SW1, and a second gate control voltage VTG2 of −5V is applied to the fourth gate electrode GE4 of the second double-gate switching element SW2. Thus, a difference between the first gate control voltage VTG1 and the first data voltage VS is 10V, and a difference between the second gate control voltage VTG2 and the second data voltage VS is 0V. Therefore, the first threshold voltage VTh1 of the first double-gate switching element SW1 decreases by 10V, and becomes substantially the same as the second threshold voltage VTh2 of the second double-gate switching element SW2.

Figure 4D:
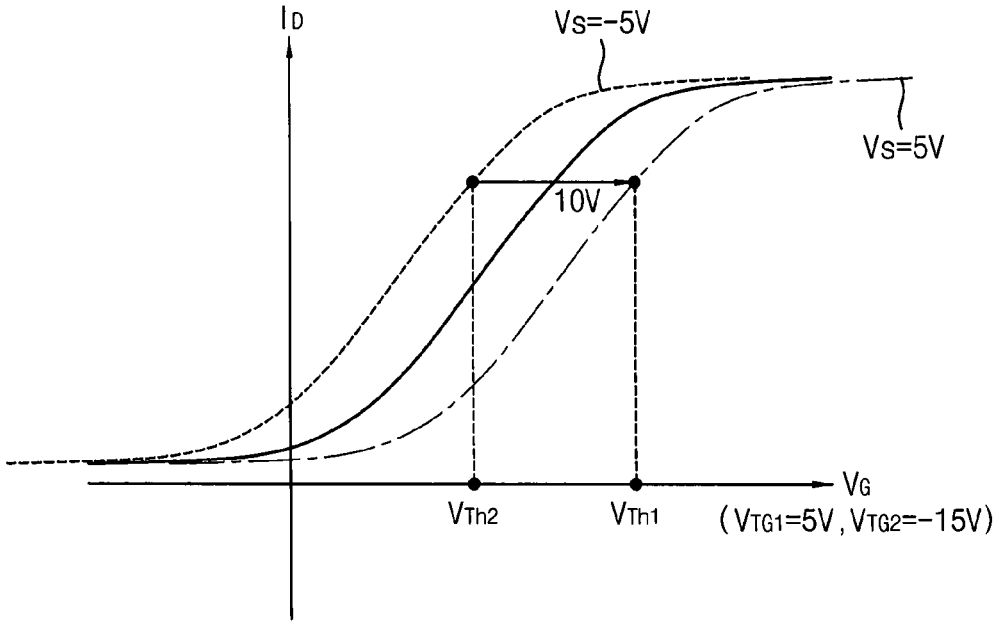
FIG. 4D is a diagram illustrating a relationship between a gate voltage of a double-gate switching element and a drain current of the double-gate switching element according to exemplary embodiments of the present inventive concept.

FIG. 4D is a diagram illustrating a relationship between a gate voltage VG of a double-gate switching element and a drain current ID of the double-gate switching element according to exemplary embodiments of the present inventive concept.

Referring to FIGS. 2A, 3A and 4D, a first threshold voltage VTh1 is a threshold voltage of the first double-gate switching element SW1 when a first data voltage VS applied to the first source electrode SE1 of the first double-gate switching element SW1 is 5V. A second threshold voltage VTh2 is a threshold voltage of the second double-gate switching element SW2 when a second data voltage VS applied to the second source electrode SE2 of the second double-gate switching element SW2 is −5V. The first threshold voltage VTh1 is greater than the second threshold voltage VTh2 by 10V.

In this case, in an exemplary scenario, a first gate control voltage VTG1 of 5V is applied to the second gate electrode GE2 of the first double-gate switching element SW1, and a second gate control voltage VTG2 of −15V is applied to the fourth gate electrode GE4 of the second double-gate switching element SW2. Thus, a difference between the first gate control voltage VTG1 and the first data voltage VS is 0V, and a difference between the second gate control voltage VTG2 and the second data voltage VS is −10V. Therefore, the second threshold voltage VTh2 of the second double-gate switching element SW2 increases by 10V, and becomes substantially the same as the first threshold voltage VTh1 of the first double-gate switching element SW1.

Figure 4E:
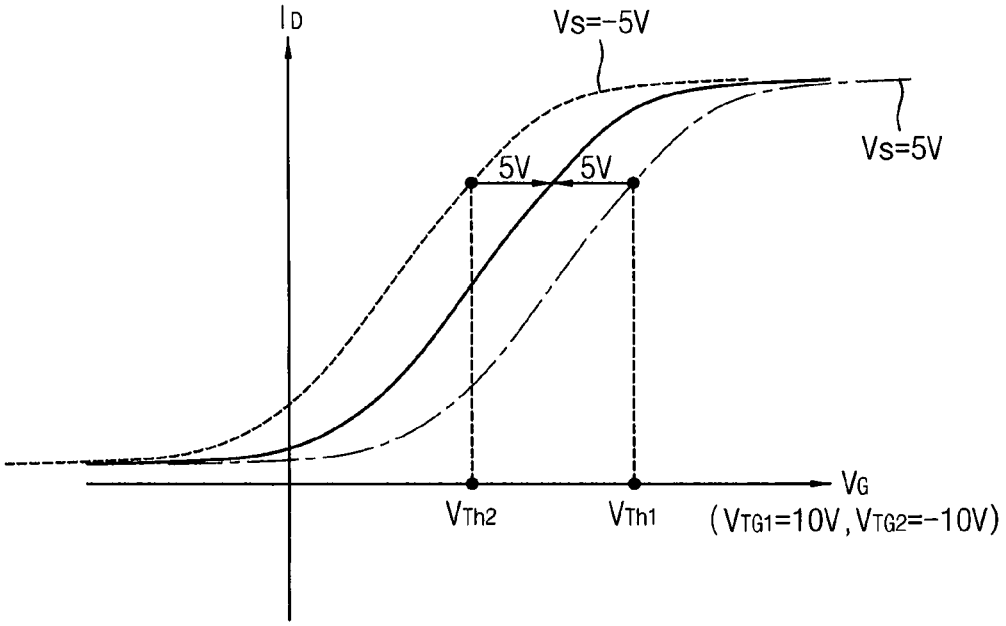
FIG. 4E is a diagram illustrating a relationship between a gate voltage of a double-gate switching element and a drain current of the double-gate switching element according to exemplary embodiments of the present inventive concept.

FIG. 4E is a diagram illustrating a relationship between a gate voltage VG of a double-gate switching element and a drain current ID of the double-gate switching element according to exemplary embodiments of the present inventive concept.

Referring to FIGS. 2A, 3A and 4E, a first threshold voltage VTh1 is a threshold voltage of the first double-gate switching element SW1 when a first data voltage VS applied to the first source electrode SE1 of the first double-gate switching element SW1 is 5V. A second threshold voltage VTh2 is a threshold voltage of the second double-gate switching element SW2 when a second data voltage VS applied to the second source electrode SE2 of the second double-gate switching element SW2 is −5V. The first threshold voltage VTh1 is greater than the second threshold voltage VTh2 by 10V.

In this case, in an exemplary scenario, a first gate control voltage VTG1 of 10V is applied to the second gate electrode GE2 of the first double-gate switching element SW1, and a second gate control voltage VTG2 of −10V is applied to the fourth gate electrode GE4 of the second double-gate switching element SW2. Thus, a difference between the first gate control voltage VTG1 and the first data voltage VS is 5V, and a difference between the second gate control voltage VTG2 and the second data voltage VS is −5V. Therefore, the first threshold voltage VTh1 of the first double-gate switching element SW1 decreases by 5V, and the second threshold voltage VTh2 of the second double-gate switching element SW2 increases by 5V. As a result, the first threshold voltage VTh1 and the second threshold voltage VTh2 become substantially the same.

According to exemplary embodiments of the present inventive concept, a bottom gate voltage may be prevented from shifting depending on a source voltage by properly adjusting a top gate voltage of a double-gate switching element. Thus, a kickback voltage can be reduced.

Figure 5:
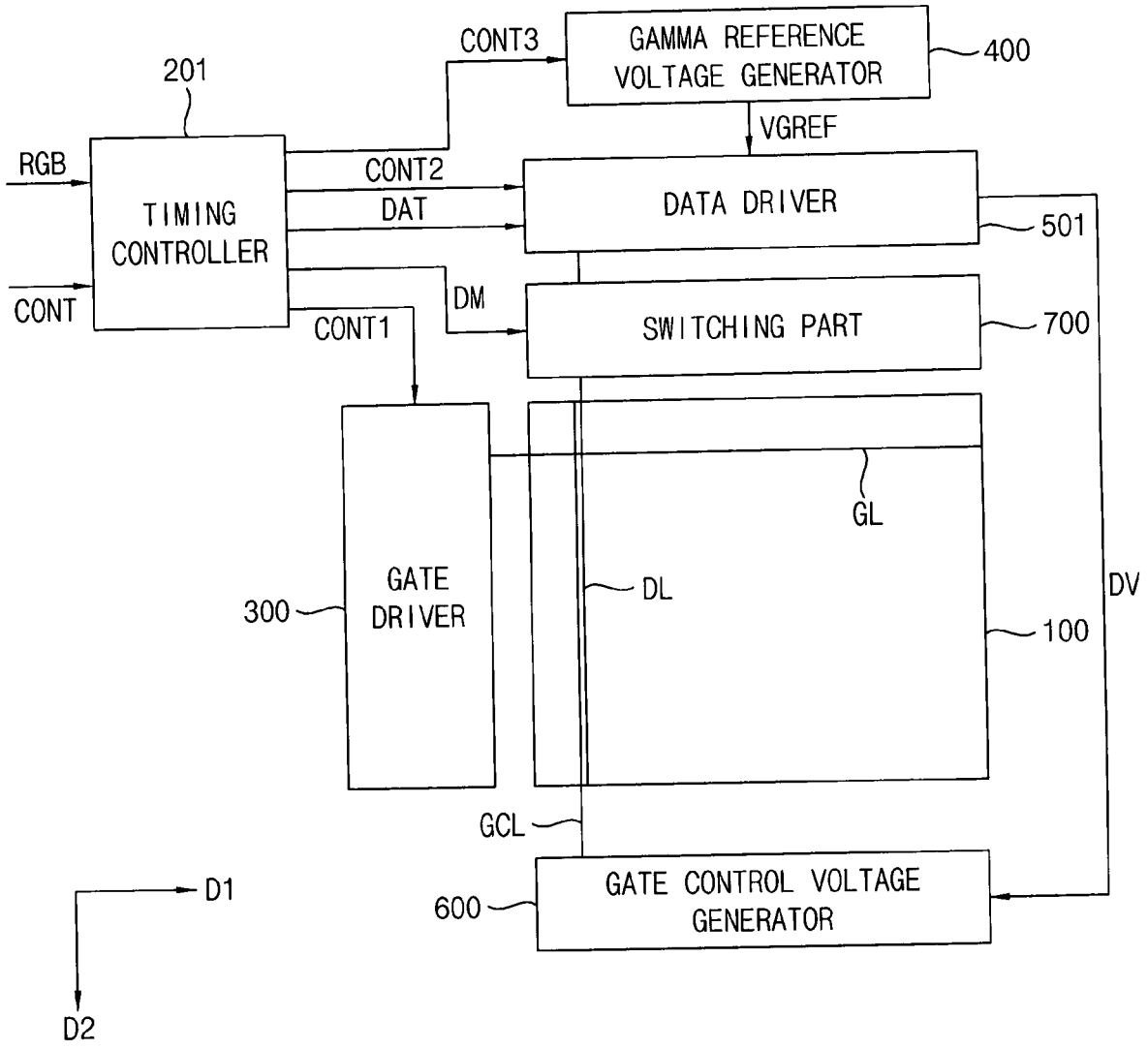
FIG. 5 is a block diagram illustrating a display apparatus according to exemplary embodiments of the present inventive concept.

FIG. 5 is a block diagram illustrating a display apparatus according to exemplary embodiments of the present inventive concept. Hereinafter, a further description of elements and operations previously described, e.g., with reference to FIG. 1, may be omitted.

Referring to FIG. 5, the display apparatus includes a display panel 100 and a panel driver. The panel driver includes a timing controller 201 (e.g., a timing controller circuit 201), a gate driver 300 (e.g., a gate driver circuit 300), a gamma reference voltage generator 400 (e.g., a gamma reference voltage generator circuit 400), a data driver 501 (e.g., a data driver circuit 501), a gate control voltage generator 600 (e.g., a gate control voltage generator circuit 600) and a switching part 700 (e.g., a switching circuit 700).

The display panel 100 includes a plurality of gate lines GL, a plurality of data lines DL, a plurality of gate control lines GCL and a plurality of pixels connected to the gate lines GL and the data lines DL. The gate lines GL extend in a first direction D1 and the data lines DL extend in a second direction D2 crossing the first direction D1. The gate control lines GCL may extend in the second direction D2.

The display panel 100 will be described in detail with reference to FIG. 6.

The timing controller 201 generates a first control signal CONT1, a second control signal CONT2, a third control signal CONT3, a data signal DAT and a switching control signal DM based on the input image data RGB and the input control signal CONT.

The data driver 501 receives the second control signal CONT2 and the data signal DAT from the timing controller 201, and receives the gamma reference voltage VGREF from the gamma reference voltage generator 400. The data driver 501 converts the data signal DAT to data voltages having analog levels based on the gamma reference voltage VGREF. The data driver 501 may include a plurality of integrated circuits (ICs). In an exemplary embodiment, the number of ICs may be less than the number of the data lines DL. The data driver 501 outputs the data voltages to the switching part 700. In an exemplary embodiment, the number data voltages output by the data driver 501 to the switching part 700 may be less than the number of the data lines DL.

The data driver 501 generates a data voltage signal DV based on the data voltages. The data driver 501 outputs the data voltage signal DV to the gate control voltage generator 600. The data voltage signal DV includes information about the data voltages.

The gate control voltage generator 600 generates gate control voltages based on the data voltage signal DV received from the data driver 501. The gate control voltage generator 600 outputs the gate control voltages to the gate control lines GCL.

In an exemplary embodiment, the switching part 700 includes a plurality of switches. The switching part 700 may operate as a de-multiplexer. The switching part 700 may divide the data voltages using a time division scheme based on operations of the switches in response to the switching control signal DM, and apply the time-divided data voltage to the data lines DL.

The switching part 700 will be described in detail with reference to FIG. 6.

Figure 6:
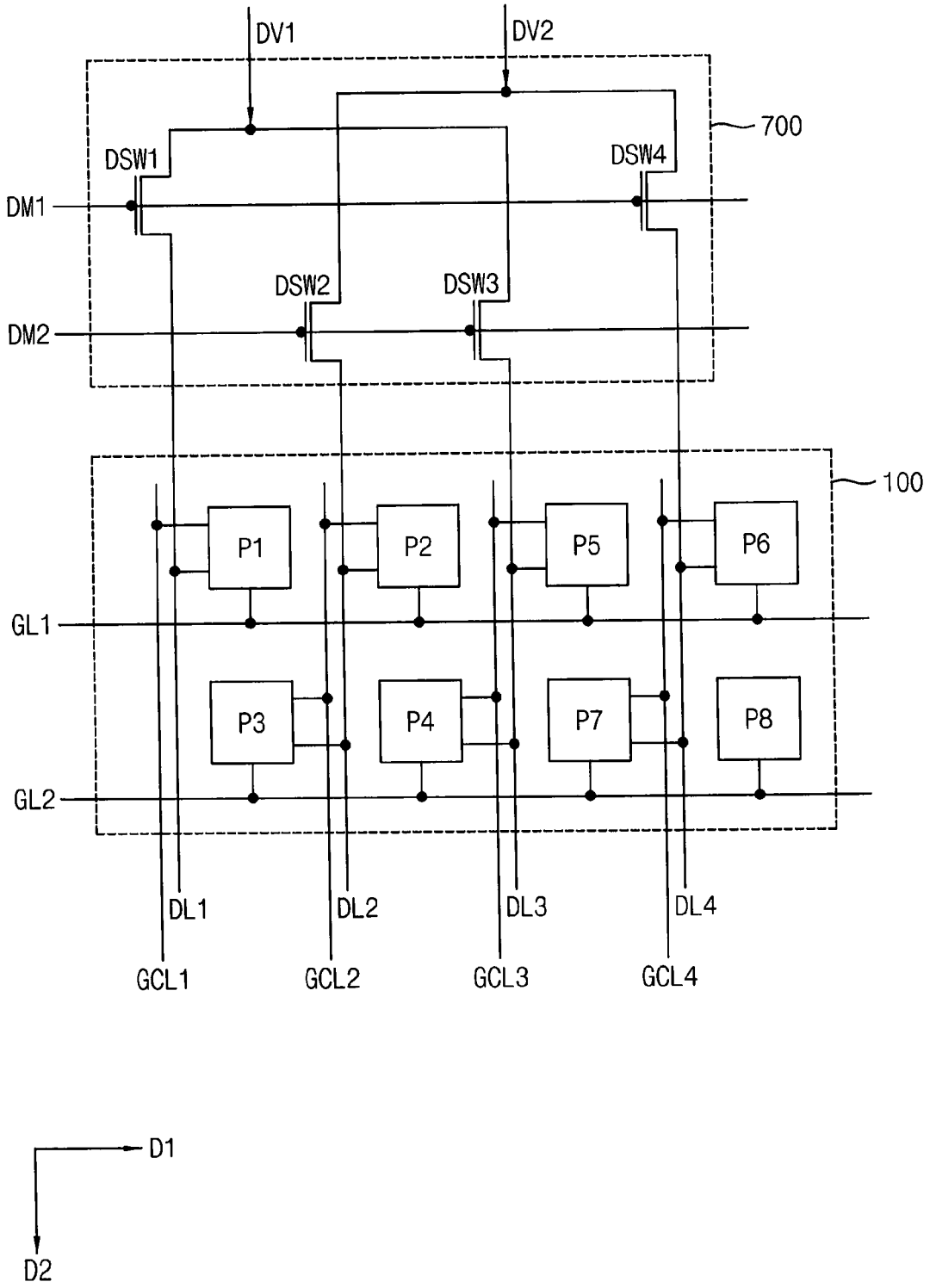
FIG. 6 is a block diagram illustrating a display panel and a switching part included in a display apparatus according to exemplary embodiments of the present inventive concept.

FIG. 6 is a block diagram illustrating a display panel and a switching part included in a display apparatus according to exemplary embodiments of the present inventive concept. Hereinafter, a further description of elements and operations previously described, e.g., with reference to FIGS. 2A and 2B, may be omitted.

Referring to FIGS. 5 and 6, the display panel 100 includes first and second gate lines GL1 and GL2 extending in the first direction D1. The display panel 100 further includes first through fourth data lines DL1, DL2, DL3 and DL4 extending in the second direction D2. The display panel 100 further includes first through fourth gate control lines GCL1, GCL2, GCL3 and GCL4. The first through fourth gate control lines GCL1 to GCL4 may extend in the second direction D2.

The display panel 100 further includes first through eighth pixels P1, P2, P3, P4, P5, P6, P7 and P8. The first through eighth pixels P1 to P8 may be arranged in a matrix configuration. The fifth pixel P5 may be adjacent to the second pixel P2 along the first direction D1. The sixth pixel P6 may be adjacent to the fifth pixel P5 along the first direction D1. The seventh pixel P7 may be adjacent to the fourth pixel P4 along the first direction D1. The eighth pixel P8 may be adjacent to the seventh pixel P7 along the first direction D1. The first through fourth pixels P1 to P4 have substantially the same structure and the same connection configuration as the first through fourth pixels of FIG. 2B. The fifth through eighth pixels P5 to P8 have substantially the same structure and the same connection configuration as the first through fourth pixels of FIG. 2B.

For example, as described above, the first pixel P1 includes a first double-gate switching element SW1. The first pixel P1 may further include a first liquid crystal capacitor Clc1 and a first storage capacitor. The first double-gate switching element SW1 includes first and second gate electrodes, a first source electrode and a first drain electrode. The first gate electrode may be a bottom gate electrode. The second gate electrode may be a top gate electrode. The first gate electrode is connected to the first gate line GL1. The first source electrode is connected to the first data line DL1. The second gate electrode is connected to the first gate control line GCL1. The first drain electrode may be connected to the first liquid crystal capacitor Clc1. The second through eighth pixels P2 to P8 have substantially the same structure and the same connection configuration as the first pixel P1.

The display panel 100 may further include a fifth data line and a fifth gate control line adjacent to the eighth pixel P8. The eighth pixel P8 may be connected to the fifth data line and the fifth gate control line.

The switching part 700 includes first through fourth switches DSW1, DSW2, DSW3 and DSW4. The switching part 700 receives first and second data voltages DV1 and DV2 from the data driver 501. The first data voltage DV1 may correspond to pixels connected to the first data line DL1 and the third data line DL3. The second data voltage DV2 may correspond to pixels connected to the second data line DL2 and the fourth data line DL4. The switching part 700 receives first and second switching control signals DM1 and DM2 from the timing controller 201.

The first switch DSW1 and the third switch DSW3 divide the first data voltage DV1 using the time division scheme based on the first switching control signal DM1 and the second switching control signal DM2, and apply the time-divided first data voltage to the first data line DL1 and the third data line DL3.

The second switch DSW2 and the fourth switch DSW4 divide the second data voltage DV2 using the time division scheme based on the first switching control signal DM1 and the second switching control signal DM2, and apply the time-divided second data voltage to the second data line DL2 and the fourth data line DL4.

According to exemplary embodiments of the present inventive concept, in a method of performing de-multiplex driving in a case in which a gap of charging rates between each of a plurality of data lines become maximized, a bottom gate voltage may be prevented from shifting depending on a source voltage by properly adjusting a top gate voltage of a double-gate switching element.

The exemplary embodiments described herein may be used in a display apparatus and/or a system including the display apparatus such as, for example, a mobile phone, a smartphone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

While the present inventive concept has been particularly shown and described with reference to the exemplary embodiments thereof, it will be understood by those of ordinary skill in the art that various changes in form and detail may be made therein without departing from the spirit and scope of the present inventive concept as defined by the following claims.

What is claimed is:

1. A display panel, comprising:

a first gate line extending in a first direction;

a first data line and a second data line extending in a second direction crossing the first direction;

a first gate control line and a second gate control line, wherein the first and second gate control lines each comprise a first portion extending in the second direction and a second portion extending in the first direction, and the second portion of the first gate control line overlaps the first data line;

a first pixel comprising a first double-gate switching element, wherein the first double-gate switching element comprises a first gate electrode connected to the first gate line, a first source electrode connected to the first data line, and a second gate electrode connected to the first gate control line; and a second pixel comprising a second double-gate switching element, wherein the second double-gate switching element comprises a third gate electrode connected to the first gate line, a second source electrode connected to the second data line, and a fourth gate electrode connected to the second gate control line, wherein a first data voltage having a first polarity is applied to the first data line, a second data voltage having a second polarity different from the first polarity is applied to the second data line, a first gate control voltage is applied to the first gate control line, and a second gate control voltage is applied to the second gate control line, wherein a level of the first gate control voltage is different from a level of the second gate control voltage, wherein the first gate control voltage is generated independently from the second gate control voltage, and wherein the first gate control voltage is output to the second gate electrode of the first double-gate switching element through the first gate control line, and the second gate control voltage is output to the fourth gate electrode of the second double-gate switching element through the second gate control line.

2. The display panel of claim 1, wherein the first polarity is a positive polarity and the second polarity is a negative polarity.

3. The display panel of claim 1, wherein a difference between a first voltage and a second voltage is substantially the same as a difference between the first data voltage and the second data voltage, wherein the first voltage is a difference between the first gate control voltage and the first data voltage, and the second voltage is a difference between the second gate control voltage and the second data voltage.

4. The display panel of claim 3, wherein the second gate control voltage is substantially the same as the second data voltage.

5. The display panel of claim 1, wherein the first gate control line overlaps with the first data line, and the second gate control line overlaps with the second data line.

6. The display panel of claim 1, further comprising:

a second gate line extending in the first direction;

a third data line and a third gate control line extending in the second direction;

a third pixel adjacent to the first pixel along the second direction, wherein the third pixel comprises a third double-gate switching element comprising a fifth gate electrode connected to the second gate line, a third source electrode connected to the second data line, and a sixth gate electrode connected to the second gate control line; and a fourth pixel adjacent to the second pixel along the second direction, wherein the fourth pixel comprises a fourth double-gate switching element comprising a seventh gate, electrode connected to the second gate line, a fourth source electrode connected to the third data line, and an eighth gate electrode connected to the third gate control line, wherein a third data voltage having the first polarity is applied to the third data line, and the first gate control voltage is applied to the third gate control line.

7. A display apparatus, comprising:

a display panel, comprising:

a first gate line extending in a first direction;

a first data line and a second data line extending in a second direction crossing the first direction;

a first gate control line and a second gate control line;

a first pixel comprising a first double-gate switching element, wherein the first double-gate switching element comprises a first gate electrode connected to the first gate line, a first source electrode connected to the first data line, and a second gate electrode connected to the first gate control line;

a second pixel comprising a second double-gate switching element, wherein the second double-gate switching element comprises a third gate electrode connected to the first gate line, a second source electrode connected to the second data line, and a fourth gate electrode connected to the second gate control line;

a second gate line extending in the first direction; and a third data line and a third gate control line extending in the second direction;

a third pixel adjacent to the first pixel along the second direction, wherein the third pixel comprises a third double-gate switching element comprising fifth gate electrode connected to the second gate line, a third source electrode connected to the second data line, and a sixth gate electrode connected to the second gate control line;

a gate driver configured to apply a first gate signal to the first gate line;

a data driver configured to apply a first data voltage having a first polarity to the first data line, and a second data voltage having a second polarity different from the first polarity to the second data line; and a gate control voltage generator configured to apply a first gate control voltage to the first gate control line, and a second gate control voltage different from the first gate control voltage to the second gate control line.

8. The display apparatus of claim 7, wherein the first polarity is a positive polarity and the second polarity is a negative polarity.

9. The display apparatus of claim 7, wherein a difference between a first voltage and a second voltage is substantially the same as a difference between the first data voltage and the second data voltage, wherein the first voltage is a difference between the first gate control voltage and the first data voltage, and the second voltage is a difference between the second gate control voltage and the second data voltage.

10. The display apparatus of claim 7, wherein the first and second gate control lines extend in the second direction.

11. The display apparatus of claim 10, wherein the first gate control line overlaps with the first data line, and the second gate control line overlaps with the second data line.

12. The display apparatus of claim 7, wherein the display panel further comprises:

a fourth pixel adjacent to the second pixel along the second direction, wherein the fourth pixel comprises a fourth double-gate switching element comprising a seventh gate electrode connected to the second gate line, a fourth source electrode connected to the third data line, and an eighth gate electrode connected to the third gate control line, wherein the gate driver is configured to apply a second gate signal to the second gate line, and the gate control voltage generator is configured to apply the first gate control voltage to the third gate control line.

13. The display apparatus of claim 12, wherein the data driver is configured to apply a third data voltage having the first polarity to the third data line.

14. The display apparatus of claim 12, further comprising:

a switching part comprising a plurality of switches, wherein the switching part is configured to divide the first data voltage using a time division scheme based on operations of the switches, and apply the time-divided first data voltage to the first and third data lines.

15. A method of driving a display panel, comprising:

applying a first gate signal to a first gate electrode of a first double-gate switching element of a first pixel of the display panel via a first gate line extending in a first direction;

applying the first gate signal to a third gate electrode of a second double-gate switching element of a second pixel of the display panel via the first gate line;

applying a first data voltage having a first polarity to a first source electrode of the first double-gate switching element via a first data line extending in a second direction crossing the first direction;

applying a second data voltage having a second polarity different from the first polarity to a second source electrode of the second double-gate switching element via a second data line extending in the second direction, wherein the first and second data voltages are generated by a data driver;

generating, by a gate control voltage generator, a first gate control voltage and a second gate control voltage, wherein the gate control voltage generator receives a data voltage signal based on the first and second data voltages directly from the data driver, and generates the first and second gate control voltages based on the data voltage signal, wherein a level of the second gate control voltage is different from a level of the first gate control voltage;

applying the first gate control voltage to a second gate electrode of the first double-gate switching element, wherein the first gate control voltage is output to the second gate electrode through a first gate control line extending in the second direction; and applying the second gate control voltage to a fourth gate electrode of the second double-gate switching element, wherein the second gate control voltage is output to the fourth gate electrode through a second gate control line extending in the second direction, wherein the first gate control voltage is generated independently from the second gate control voltage.

16. The method of claim 15, wherein the first polarity is a positive polarity and the second polarity is a negative polarity.

17. The method of claim 15, wherein a difference between a first voltage and a second voltage is substantially the same as a difference between the first data voltage and the second data voltage, wherein the first voltage is a difference between the first gate control voltage and the first data voltage, and the second voltage is a difference between the second gate control voltage and the second data voltage.

18. The method of claim 17, wherein the second gate control voltage is substantially the same as the second data voltage.

19. The method of claim 15, further comprising:

dividing the first data voltage using a time division scheme;

applying the time-divided first data voltage to the first source electrode and a third source electrode of a third double-gate switching element of a third pixel of the display panel; and applying the first gate control voltage to a sixth gate electrode of the third double-gate switching element, wherein the third double-gate switching element further comprises a fifth gate electrode.

* * * * *